United States Patent [19]

Hosaka

[11] 4,144,847

[45] Mar. 20, 1979

[54] EMISSION CONTROL APPARATUS FOR INTERNAL ENGINES WITH MEANS FOR GENERATING STEP FUNCTION VOLTAGE COMPENSATING SIGNALS

[75] Inventor: Akio Hosaka, Yokohama, Japan

[73] Assignee: Nissan Motor Company, Limited, Yokohama, Japan

[21] Appl. No.: 753,787

[22] Filed: Dec. 23, 1976

[30] Foreign Application Priority Data

Dec. 27, 1975 [JP] Japan ..... 50/155774

[51] Int. Cl.[2] ..... F02B 3/00

[52] U.S. Cl. ..... 123/32 EE; 123/32 EB;

[58] Field of Search ..... 60/285, 123/32 EB, 32 ED, 32 EE, 123/32 EH, 32 EI, 32 EC, 139 DE, 139 BG, 139 AY

[56] References Cited

U.S. PATENT DOCUMENTS

| | | | |
|---|---|---|---|
| 3,749,065 | 7/1973 | Rothfusz et al. | 123/32 EH |
| 3,759,232 | 9/1973 | Wahl et al. | 123/32 EE |
| 3,871,338 | 3/1975 | Schmidt et al. | 60/285 |
| 3,911,872 | 10/1975 | Hughes | 123/32 EB |
| 3,916,848 | 11/1975 | Schmidt | 123/32 EE |
| 3,919,983 | 11/1975 | Wahl et al. | 123/32 EE |
| 3,952,710 | 4/1976 | Kawarada et al. | 123/32 EE |
| 3,973,529 | 8/1976 | Wessel et al. | 123/32 EE |
| 4,031,866 | 6/1977 | Asano | 123/32 EB |
| 4,046,118 | 9/1977 | Aono | 123/32 EE |

FOREIGN PATENT DOCUMENTS

| | | | |
|---|---|---|---|
| 965858 | 4/1975 | Canada | 123/32 EH |

*Primary Examiner*—Ronald H. Lazarus
*Assistant Examiner*—Raymond A. Nelli
*Attorney, Agent, or Firm*—Schwartz, Jeffery, Schwaab, Mack, Blumenthal & Koch

[57] ABSTRACT

Emission control apparatus for an internal combustion engine includes a sensor for detecting the concentration of an exhaust composition to generate an error correction signal for controlling the air-fuel mixture ratio at a predetermined value to minimize noxious exhaust emissions and a transient compensation circuit to provide a step function voltage to compensate for transient engine operating condition in response to a sensed change of engine load.

5 Claims, 3 Drawing Figures

EMISSION CONTROL APPARATUS FOR INTERNAL ENGINES WITH MEANS FOR GENERATING STEP FUNCTION VOLTAGE COMPENSATING SIGNALS

FIELD OF THE INVENTION

The present invention relates to closed-loop emission control apparatus for internal combustion engines in which compensation signals are generated in response to a sensed sudden change of engine load to compensate for leaner mixture during acceleration and richer mixture during deceleration.

BACKGROUND OF THE INVENTION

In a closed-loop emission control system for internal combustion engines, the concentration of exhaust composition is detected to provide an error correction signal with which the mixture ratio of air to fuel is controlled at a predetermined value. However, due to the transport delay time of the engine involved in induction of air and fuel, combustion of the mixture and emission of the exhaust gases in each cylinder cycle, the closed-loop control is not capable of responding to a sudden change of load such as acceleration or deceleration and therefore a loss of power will be encountered when the engine is suddenly accelerated. In a prior art system in which a throttle position sensor is provided, a differentiator circuit is connected to the output of throttle position sensor. The differentiator output is then impressed upon the error correction signal to compensate for the transient engine operating conditions when throttle position has suddenly changed.

SUMMARY OF THE INVENTION

An object of the present invention is to provide an improved closed-loop emission control system for an internal combustion engine capable of responding to a sudden change of engine load.

The improved emission control system according to the present invention is characterized by the fact that a step function voltage of positive or negative polarity depending on a sensed acceleration or deceleration is impressed upon the error correction signal to generate a compensation signal. Preferably, the step voltage is impressed upon a mean value of the error correction signal, or alternatively, impressed upon the error correction signal of amplitude immediately prior to the detection of the change of engine load. The error correction signal is therefore instantaneously varied in a given direction and remains there for appropriate duration so that additional amount of fuel is supplied to the engine to compensate for loss of power during acceleration, or instantaneously varied in the opposite direction and remains there for appropriate duration so that mixture is leaned to compensate for the richer mixture during deceleration.

Another object of the present invention is to provide emission control apparatus which assures good drivability when sudden change of load is encountered.

A further object of the invention is to minimize the amount of noxious emissions during the period of acceleration or deceleration.

BRIEF DESCRIPTION OF THE DRAWINGS

Further details will be explained below with the help of the examples illustrated in the accompanying drawings in which.

DESCRIPTION OF THE PREFERRED EMBODIMENTS

Figure 1:
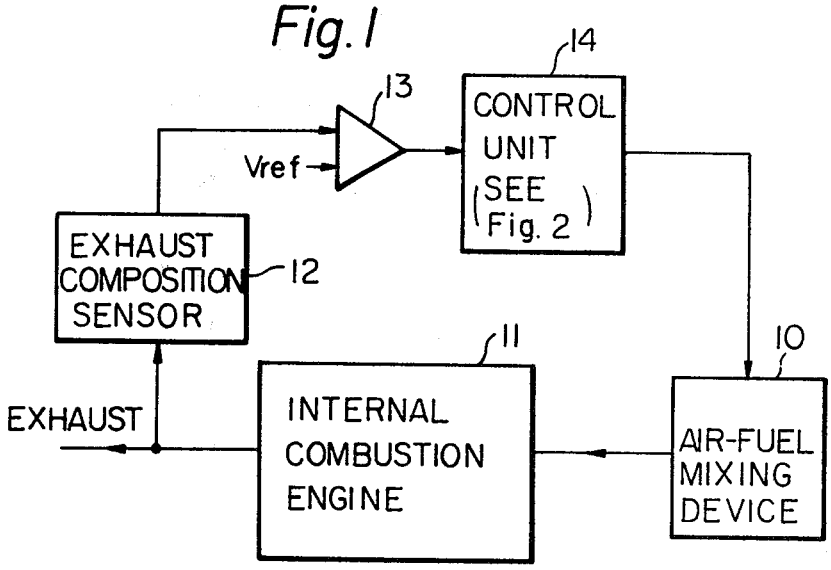
FIG. 1 is a schematic illustration of emission control apparatus embodying the invention.

In FIG. 1, an air-fuel mixing and proportioning device 10 supplies mixture of air and fuel to an internal combustion engine 11. In the exhaust passage of the engine is provided an exhaust composition sensor 12 of the type which senses the concentration of residual composition such as oxygen in the exhaust emissions and provides an output having a characteristic change in amplitude in the neighborhood of the stoichiometric air-fuel ratio of the combusted mixture. The output from the exhaust gas sensor 12 is applied to a comparator 13 for comparison with a reference voltage Vref to provide a signal representative of the difference between the two voltages. A control unit 14 accepts the signal from the comparator 13 to generate an error correction signal which is in turn coupled to the air-fuel mixing and proportioning device 10. The mixing device 10 may be a carburetor with a control valve operated by the signal from the control unit 14 either in analog or digital form, or a fuel injector controlled in analog or digital form.

Figure 2:
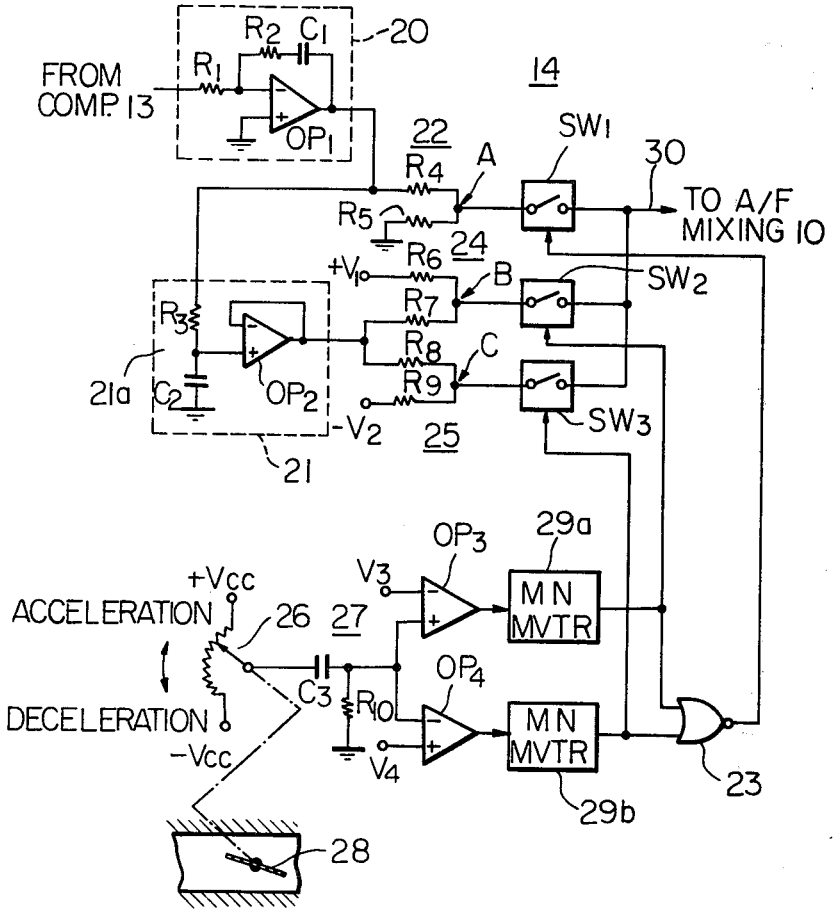
FIG. 2 is a circuit diagram of a control unit used in the embodiment of FIG. 1.

FIG. 2 illustrates in detail the control unit 14. The output from the comparator 13 is fed into the inverting input of an operational amplifier OP1 through an input resistor R1. The inverting input is connected through a series-connection of resistor R2 and capacitor C1 to the output terminal, the noninverting input being connected to ground. With this circuit configuration, the output signal from the operational amplifier OP1 is a sum of proportional amplification by the factor of R2/R1 and integration by the time constant R1C1, respectively, of the comparator output. Therefore, the circuit 20 formed by the operational amplifier OP1, resistors R1, R2 and capacitor C1 acts as a proportional-integral controller which generates a basic error correction signal. This signal is applied to an averaging circuit 21 formed by an operational amplifier OP2 and an RC filter **21*a* formed by resistor R3 and capacitor C2. The output from the PI controller 20 is connected to one end of the resistor R3 the other end of which is connected to the noninverting input of the operational amplifier OP2 and through the capacitor C2 to ground. The inverting input of the operational amplifier OP2 is connected to the output thereof so that the amplifier OP2** acts as a buffer amplifier stage.

The output from the PI controller 20 is also connected through a voltage divider 22 formed by a series-connected resistors R4 and R5 to an electronic switching gate SW1 and thence to air-fuel mixing device 10 through an output lead 30, the switch SW1 being closed by a control signal from a NOR gate 23.

The output of averaging circuit 21 is connected to a junction between a second voltage divider 24 formed by a series-connected resistors R6 and R7 and a third voltage divider 25 formed by a series-connected resistors R8 and R9. The voltage divider 24 is connected at the other end to a positive voltage supply $+V_1$ and voltage divider 25 is connected at the other end to a negative voltage supply $-V_2$.

The voltage at the junction B between resistors R6 and R7 is a sum of the output voltage from operational amplifier OP2 and the positive voltage $V_1$ divided by the ratio of resistances R6 to R7. This voltage serves as a first correcting signal substituted for the basic control signal provide a rich mixture during acceleration periods and is coupled through an electronic switching gate SW2 to the output lead 30.

The voltage at the junction C between resistors R8 and R9 is a sum of the output voltage from operational amplifier OP2 and the negative voltage $V_2$ divided by the ratio of resistances R8 and R9. This voltage serves as a second correcting signal substitute for the basic control signal to provide a lean mixture during deceleration periods and is applied through a third electronic switching gate SW3 to the output lead 30.

In order to sense acceleration and deceleration conditions of the vehicle, a potentiometer or throttle position transducer 26 is connected between a positive voltage supply +Vcc and a negative voltage supply −Vcc. A differentiator 27 formed by resistor R10 and capacitor C3 is connected to the tap point of the potentiometer 26 to provide a differentiated voltage across the resistor R10. The potentiometer wiper is operatively connected by a linkage as indicated by dot-dash lines to the throttle valve 28 for unitary movement therewith. The voltage developed across the resistor R10 represents the rate of movement of the throttle valve 28, and is applied to the noninverting input of a first operational amplifier comparator OP3 for comparison with a reference voltage $V_3$ and also to the inverting input of a second comparator OP4 for comparison with a reference voltage $V_4$. The comparator OP3 will be switched on to the output-high state when the potential at the non-inverting input is above the reference voltage $V_3$ to activate a first monostable multivibrator 29*a* producing a pulse with a predetermined duration. The comparator OP4 will be triggered into the output-high state when the potential at the inverting input is below the reference potential $V_4$ to activate a second monostable multivibrator 29*b*. The outputs from the monostable multivibrators 29*a* and 29*b* are connected on the one hand to respective ones of the input terminals of the NOR gate 23 and on the other hand to the control terminals of electronic switching gates SW2 and SW3, respectively. The output from monostable 29*a* is thus an indication of acceleration condition and the output from monostable 29*b* is an indication of deceleration condition. When both conditions do not exist, the NOR gate 23 will be activated to place a logic "1" to the control terminal of switching gate SW1 to connect the potential at the junction A to the output lead 30 and thence to the air-fuel mixing and proportioning device 10.

The output from the PI controller 20 is smoothed out by the RC filter 21*a* so that the output delivered from the operational amplifier OP2 can be regarded as a mean value of the amplitude of the signal from the PI controller during the period of acceleration or deceleration, or the period of monostable multivibrators 29*a* and 29*b*. Therefore, the potential at the junction B is a value proportional to the average value of the basic control signal at the moment of acceleration from the PI controller 20 plus a positive step function voltage from the voltage supply $+V_1$, and the potential at the junction C is a value proportional to the average value of the basic control signal at the moment of deceleration plus a negative step function voltage from the voltage supply $-V_2$.

Upon detection of acceleration, the monostable multivibrator 29*a* is activated to provide a control signal to the switch SW2 to apply the potential at junction B to the air-fuel mixing device 10 through lead 30. As a result, an additional amount of fuel is supplied to the internal combustion engine 11 without loss of time and fuel deficiency during the acceleration period is compensated.

Upon detection of deceleration, the monostable multivibrator 29*b* is activated to provide a control signal to the switch SW3 to apply the potential at junction C to the air-fuel mixing device 10 to instantly decrease the supply of fuel to the engine so that richness during the deceleration period is compensated.

Figure 3:
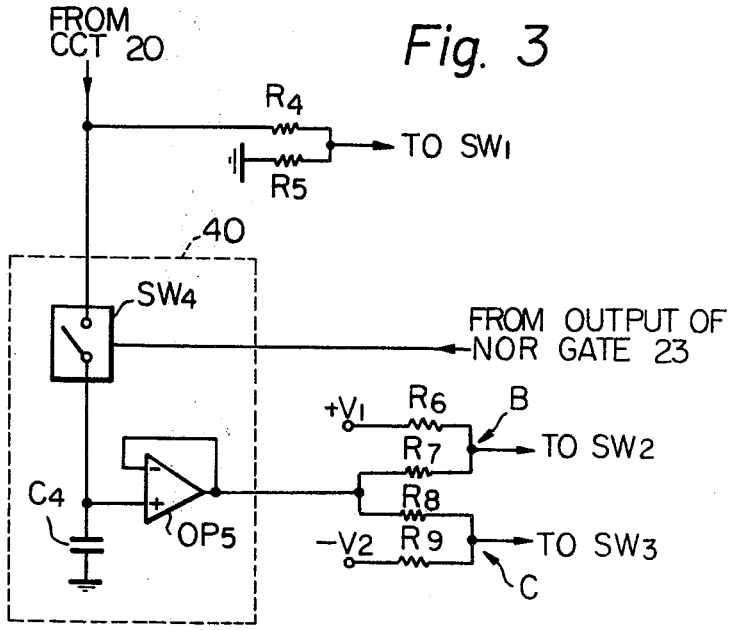
FIG. 3 is a modification of the circuit of FIG. 2.

The averaging circuit 21 of FIG. 2 may be replaced with a circuit 40 as shown in FIG. 3 in which the output from the PI controller 20 is connected through an electronic switching gate SW4 to the noninverting input of an operational amplifier OP5 and also to one terminal of a capacitor C4, the opposite terminal of which is connected to ground. The logic "1" output from the NOR gate 23 is connected to the control terminal of electronic switching gate SW4 so that the switching gate SW4 is normally closed to charge the capacitor C4.

When acceleration or deceleration is detected, NOR gate 23 will be switched on to a logic "0" state which causes the switching gate SW4 to open. The voltage developed across the capacitor C4 represents the value of the controller output at the instant immediately prior to the detection of acceleration or deceleration. The operational amplifier OP5 has its inverting input connected to its output terminal to act as a buffer amplifier in a manner identical to the operational amplifier OP2 of the previous embodiment to generate compensation voltages at the junction B or C.

What is claimed is:

1. A closed loop mixture control system for an internal combustion engine having a throttle valve and means for supplying a mixture of air and fuel thereto in a variable ratio in response to a control signal representative of the deviation of the air-fuel ratio within the exhaust system of the engine, wherein the system includes means for modifying the amplitude of the control signal to control the air-fuel ratio to a desired value, comprising:

means for sensing the rate of movement of said throttle valve and providing a first output signal corresponding thereto;

means for detecting the presence of acceleration and deceleration of said engine utilizing said first output signal and providing a second output signal wherever said rate of movement of said throttle valve exceeds a predetermined threshold level;

means for generating a signal representing a time integral of said modified control signal;

a source for providing a first and a second DC voltage;

means for combining said time integral representing signal with said first DC voltage to generate a first voltage signal and for combining said time integral representing signal with said second DC voltage to generate a second voltage signal; and means for applying said first and second voltage signals to said air-fuel supply means in response to the detection of said acceleration or deceleration whereby a rich air-fuel mixture is supplied to said engine under acceleration and a lean air-fuel mixture is supplied to said engine under deceleration.

2. A closed loop mixture control system as claimed in claim 1, wherein said combining comprises a voltage dividing network connected at one end to a first voltage source and at the other end to a second voltage source, an intermediate point of said network being connected to the output of said time integral signal generating means.

3. A closed loop mixture control system as claimed in claim 1, wherein said sensing means comprises means connected to said throttle valve for generating a voltage of a first or a second polarity in response to the position of said throttle valve with respect to a reference point, the amplitude of said voltage being a function of the deviation of said position from said reference point, and a differentiator for generating a signal representative of the differentiation of said voltage.

4. A closed loop mixture control system as claimed in claim 3, wherein said means for detecting the presence of acceleration and deceleration of said engine comprises means for comparing the differentiation representative signal with a set of predetermined threshold levels, and means for generating a pulse in response to said threshold levels being exceeded.

5. A closed loop mixture control system as claimed in claim 4, wherein said voltage applying means comprises gating means responsive to said pulse for transmitting said first and second voltage signals to said air-fuel supply means, whereby said gating means are responsive to the simultaneous absence of said first and second voltage signals, thus transmitting said modified control signal to said air-fuel supply means.

* * * * *